US010299571B2

(12) United States Patent
Eberle

(10) Patent No.: US 10,299,571 B2
(45) Date of Patent: May 28, 2019

(54) BACKPACK FOR CARRYING WEAPONS

(71) Applicant: Eberlestock USA LLC, Boise, ID (US)

(72) Inventor: Glen R. Eberle, Boise, ID (US)

(73) Assignee: Eberlestock USA LLC, Boise, ID (US)

( * ) Notice: Subject to any disclaimer, the term of this patent is extended or adjusted under 35 U.S.C. 154(b) by 10 days.

(21) Appl. No.: 15/247,048

(22) Filed: Aug. 25, 2016

(65) Prior Publication Data

US 2018/0055199 A1 Mar. 1, 2018

(51) Int. Cl.

| | |
|---|---|
| ***A45F 3/06*** | (2006.01) |
| ***F41C 33/02*** | (2006.01) |
| ***A45F 5/02*** | (2006.01) |
| ***A45C 13/10*** | (2006.01) |
| *F41C 33/06* | (2006.01) |

(52) U.S. Cl.

CPC ..... *A45F 3/06* (2013.01); *A45C 13/1069* (2013.01); *A45F 5/021* (2013.01); *F41C 33/0218* (2013.01); *A45F 2200/0591* (2013.01); *F41C 33/06* (2013.01)

(58) Field of Classification Search

CPC ..... A45F 3/06; A45F 5/021; F41C 33/005; F41C 33/0218; A45C 13/1069

See application file for complete search history.

(56) References Cited

U.S. PATENT DOCUMENTS

| | | | | |
|---|---|---|---|---|
| 6,763,987 | B1 * | 7/2004 | Eberle | A45F 3/04 224/637 |
| 7,735,701 | B2 | 6/2010 | Eberle | |
| 2007/0199966 | A1 * | 8/2007 | Korchmar | A45C 3/06 224/578 |
| 2010/0025446 | A1 * | 2/2010 | Eberle | A45F 3/04 224/652 |
| 2016/0076852 | A1 * | 3/2016 | Liu | F41C 33/0209 224/587 |

* cited by examiner

*Primary Examiner* — Corey N Skurdal
(74) *Attorney, Agent, or Firm* — Taylor IP, P.C.

(57) ABSTRACT

A backpack includes a main bag and a long gun scabbard. The long gun scabbard includes an upper sleeve and a lower sleeve, the upper sleeve having a top opening accessible by a user, the lower sleeve being defined at least in part by a folding flap associated with the main bag. The lower sleeve has a front wall which is coextensive with a front wall of the upper sleeve, and a rear wall which is coextensive with a rear wall of the upper sleeve. The backpack can also include a handgun pocket with at least one access slit arranged in the main bag. Each access slit has at least one magnetic closure for keeping the access slit in a normally closed position.

17 Claims, 9 Drawing Sheets

BACKPACK FOR CARRYING WEAPONS

BACKGROUND OF THE INVENTION

1. Field of the Invention

The present invention relates to backpacks, and, more particularly, to backpacks for carrying weapons, such as long guns or handguns.

2. Description of the Related Art

Backpacks are generally used to carry various articles, such as books, food, etc. In the case of backpacks used for hunting or military applications, they can carry optics, food, water, survival gear, bedding, etc. They can also be used to carry weapons, such as long guns.

The assignee of the present invention, Eberlestock USA LLC, is a leader in the industry for the design and manufacture of backpacks for the military and hunting markets. Eberlestock makes and sells backpacks with internal rifle scabbards which allow a soldier or hunter to carry a long gun internally within the pack, out of the way and close against the body of the user, thereby allowing use of both hands by the user. Such scabbards are effective for stowing and carrying long guns, but are not generally configured for carrying other types of weapons, such as handguns.

Eberlestock also makes and sells another type of backpack which can be used to carry multiple types of weapons. For example, U.S. Pat. No. 7,735,701 (Eberle) discloses a backpack with a lower open top pocket for receiving the lower end of the weapon, and an upper tether which loops around the upper portion of the weapon. The tether has one end affixed to one of the shoulder straps, and an opposite end which is detachably coupled to the same shoulder strap. This configuration allows the user to remove the weapon without removing the backpack. The user grasps the upper portion of the weapon above his shoulders with a hand opposite the attachment location of the tether, and then detaches the tether with the hand on the same side as the tether is attached to the shoulder strap. The weapon can then be removed from the lower pocket, without removing the backpack. This type of weapon carrying arrangement is effective but occasionally the weapon can work its way to the same side of the pack that the tether is attached, which then causes a lopsided load on the user, and allows the weapon to fall to one side of the pack.

What is needed in the art is a backpack that effectively carries multiple types of weapons on the back of the user.

SUMMARY OF THE INVENTION

The present invention provides a backpack with internal hidden accommodations for both a long gun and a handgun. These hidden accommodations for a long gun and/or handgun have caused the assignee of the present invention to refer to this backpack as their "trick pack".

The invention in one form is directed to a backpack including a main bag and a long gun scabbard. The long gun scabbard includes an upper sleeve and a lower sleeve, the upper sleeve having a top opening accessible by a user, the lower sleeve being defined at least in part by a folding flap associated with the main bag. The lower sleeve has a front wall which is coextensive with a front wall of the upper sleeve, and a rear wall which is coextensive with a rear wall of the upper sleeve.

The invention in another form is directed to a backpack including a main bag and a handgun pocket with at least one access slit arranged in the main bag. Each access slit has at least one magnetic closure for keeping the access slit in a normally closed position.

An advantage of the present invention is that the backpack has the appearance of being a normal backpack, but is configured to have both an internal rifle scabbard and handgun pocket.

Another advantage is that the handgun pocket securely stores the handgun internally within the backpack, while still allowing quick access to the handgun.

Yet another advantage is that the backpack can accommodate a long gun, while having the appearance of a normal backpack when not used with the long gun scabbard feature.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 9:
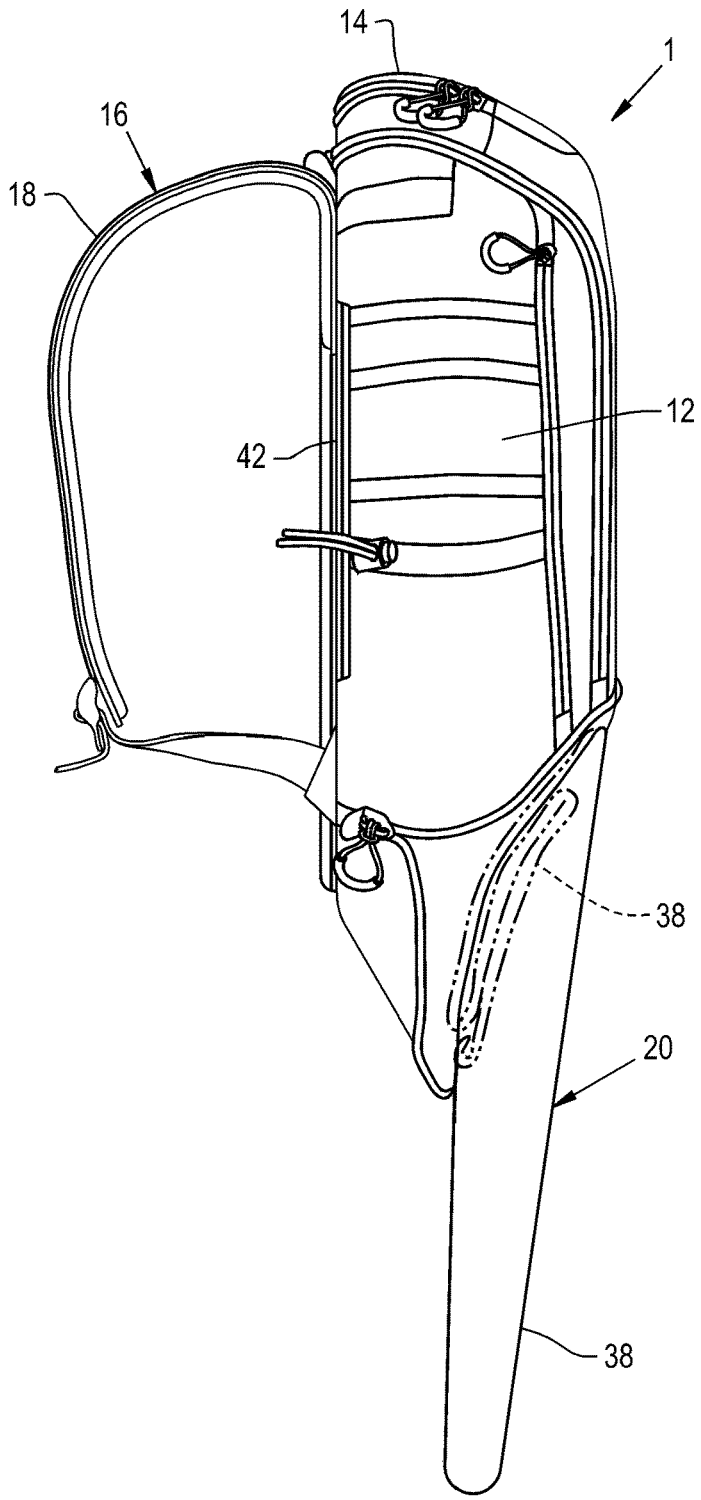
Figure 10:
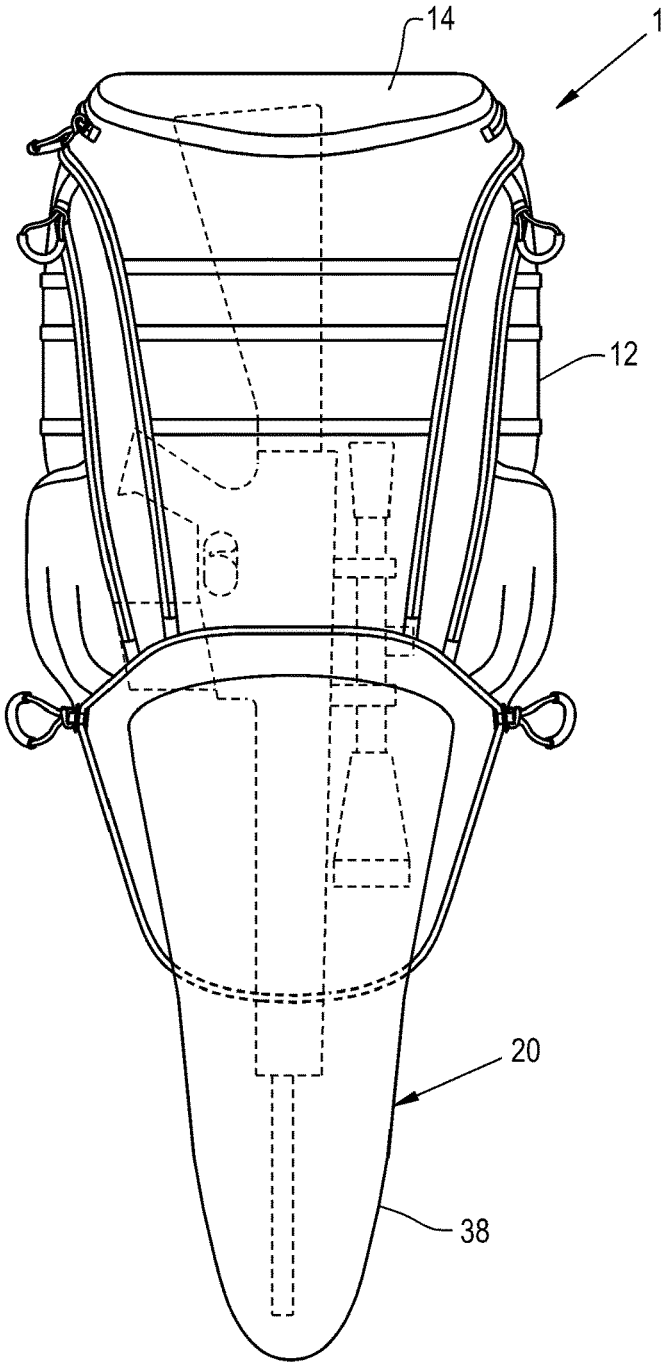

FIG. is 8 is a front view of the backpack shown in FIGS. 1-7, with a rifle shown in phantom lines within the backpack;

FIG. 9 is a side view of another embodiment of a backpack of the present invention, with a longer roll up/fold up lower sleeve to accommodate a longer rifle; and FIG. 10 is a front view of the backpack shown in FIG. 9, with a longer rifle shown in phantom lines within the backpack.

Corresponding reference characters indicate corresponding parts throughout the several views. The exemplification set out herein illustrates an embodiment of the invention, and such exemplification is not to be construed as limiting the scope of the invention in any manner.

DETAILED DESCRIPTION OF THE INVENTION

Figure 1:
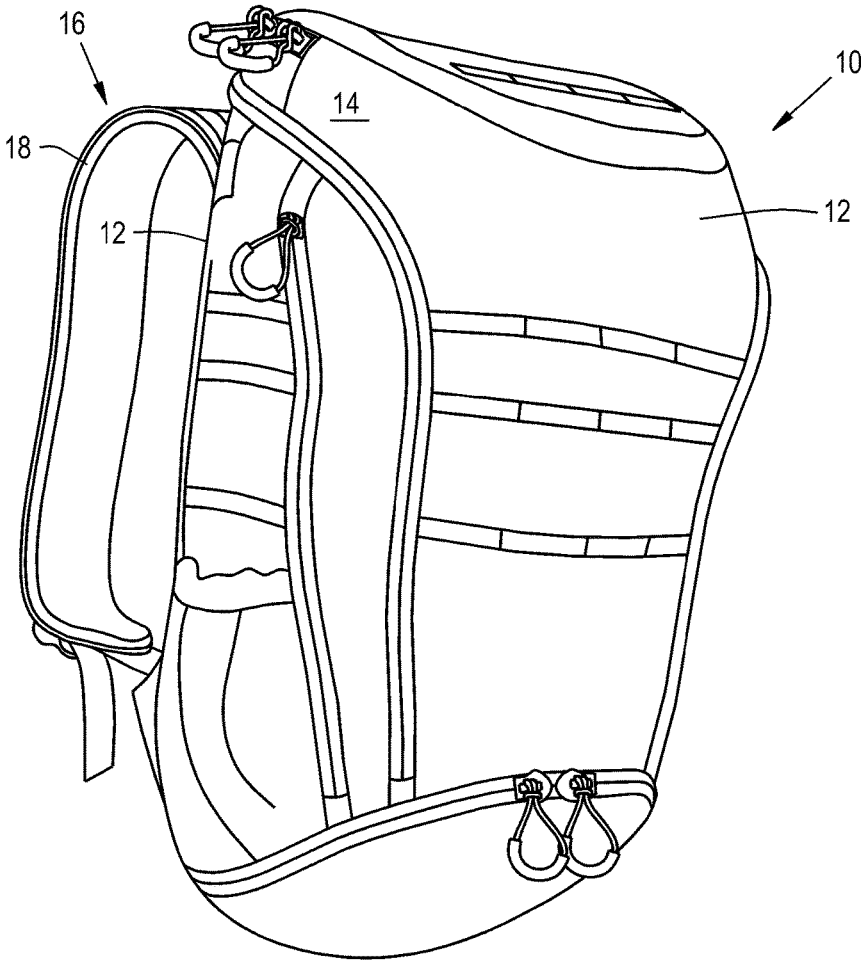
FIG. 1 is a perspective view of a backpack, including an embodiment of two separate weapons carriers of the present invention.
Figure 2:
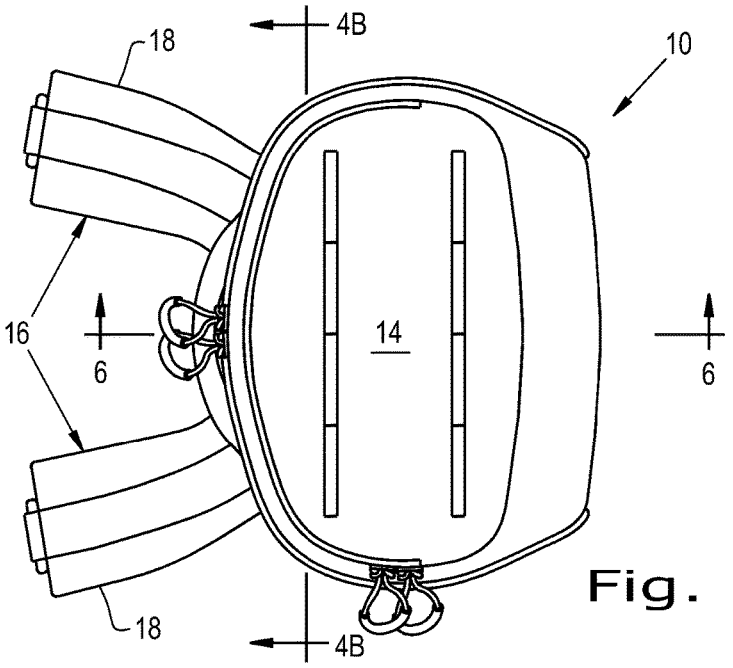
FIG. 2 is a top view of the backpack shown in FIG. 1.

Referring now to FIG. 1, there is shown a backpack 10 having a main bag 12 supported by an internal frame (not shown). Alternatively, the backpack 10 can be configured as a frameless or external frame pack while still falling within the scope of the present invention. The backpack 10 is configured as a top loader with a zippered top panel 14 providing the main access point to the interior of the main bag 12. The backpack 10 can also be configured in some embodiments as a panel loader with various zippers on the front and/or sides of the pack providing access to the interior of the main bag 12.

The backpack 10 also includes a suspension system 16 which is attached to the main bag 12. In the illustrated embodiment, the suspension system 16 includes a pair of shoulder straps 18 which are adjustable in length to fit the user. In another embodiment, the suspension system 16 can also include an adjustable waist belt (not shown), for distributing part of the load to the hips of the user.

According to an aspect of the present invention, the backpack 10 can include a weapon carrier in the form of an internal long gun scabbard 20. The long gun scabbard 20 generally includes an upper sleeve 22 and a lower sleeve 24. The upper sleeve 22 can lie along the rear wall of the main bag 12, and can be sized to carry different long guns. In the illustrated embodiment, the upper sleeve 22 has a width corresponding to the width of the main bag 12, and can thus carry a relatively tall long gun, such as an assault rifle with a pistol grip and top rail equipped with a telescopic sight. If the gun is equipped with a folding rear stock, the stock can be folded alongside the action of the gun, and the folded stock also received within the upper sleeve 22 (as opposed to extending out the top of the upper sleeve 22, which is also possible).

The lower sleeve 24 can be defined at least in part by a folding flap 26 associated with the main bag 12. The lower sleeve 24 has a front wall 28 which is coextensive with a front wall 30 of the upper sleeve 22, and a rear wall 32 which is coextensive with a rear wall 34 of the upper sleeve 22. The folding flap 26 has a zippered peripheral edge 36 which is removably attached to the main bag 12 by a zippered interconnection 36A.

When the folding flap 26 is in an unfolded position (FIG. 5-8), the upper sleeve 22 and lower sleeve 24 coact with each other to receive a long gun therein, such as an assault rifle (AR), hunting rifle, etc. To that end, the upper sleeve 22 can have a width which is the same as or less than the width of the main bag 12. In the illustrated embodiment, the upper sleeve 22 has a width corresponding to a width of the main bag 12 and thus can accommodate a long gun with a tall height, such as an AR with pistol grip and top rail with a telescopic sight.

Figure 3:
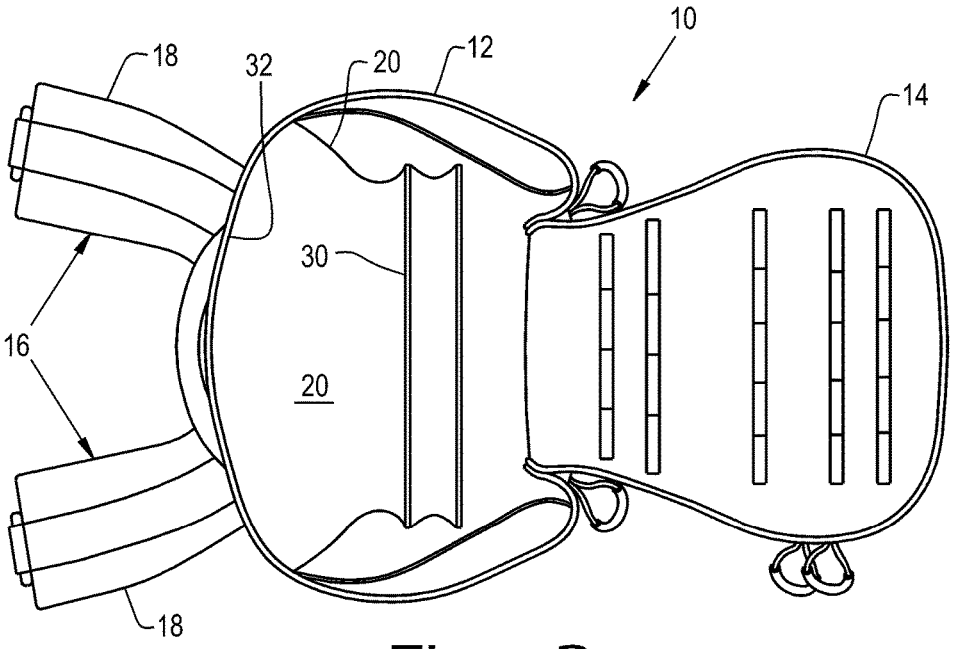
FIG. 3 is another top view of the backpack shown in FIGS. 1 and 2, with the top panel open.
Figure 4A:
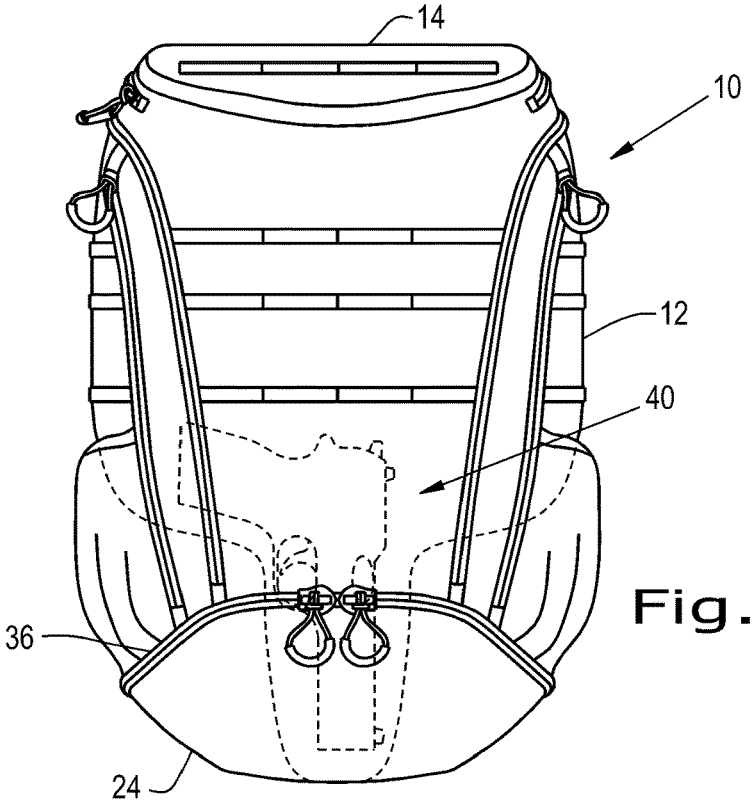
FIG. 4A is a front view of the backpack shown in FIGS. 1-3, with the top panel closed and the folding flap at the bottom zipped closed.
Figure 4B:
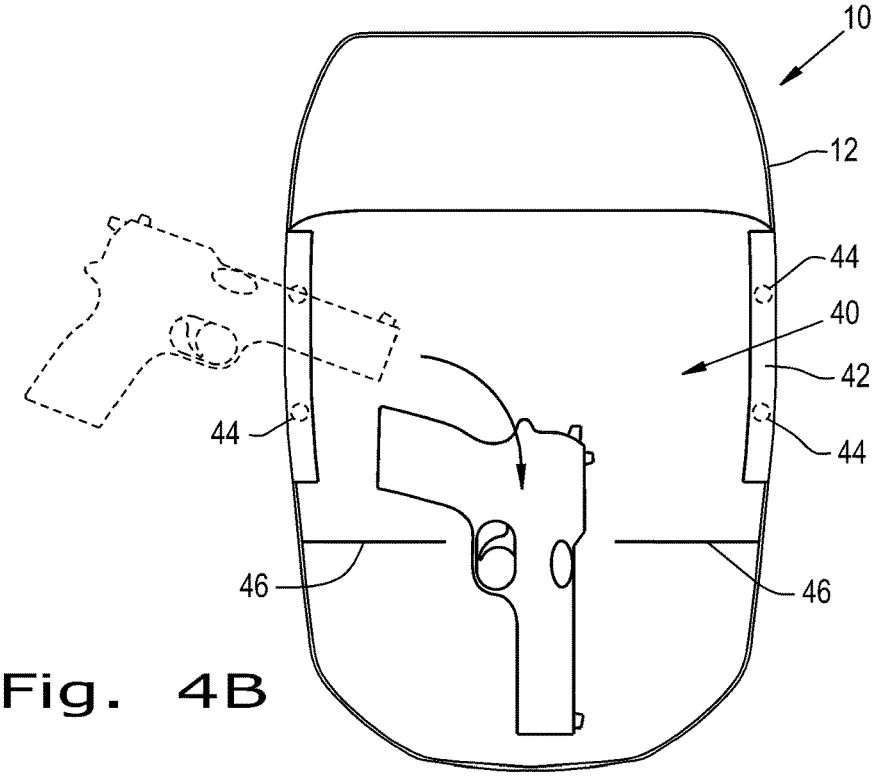
FIG. 4B is a sectional view taken along the section line 4B-4B shown in FIG. 2.
Figure 5:
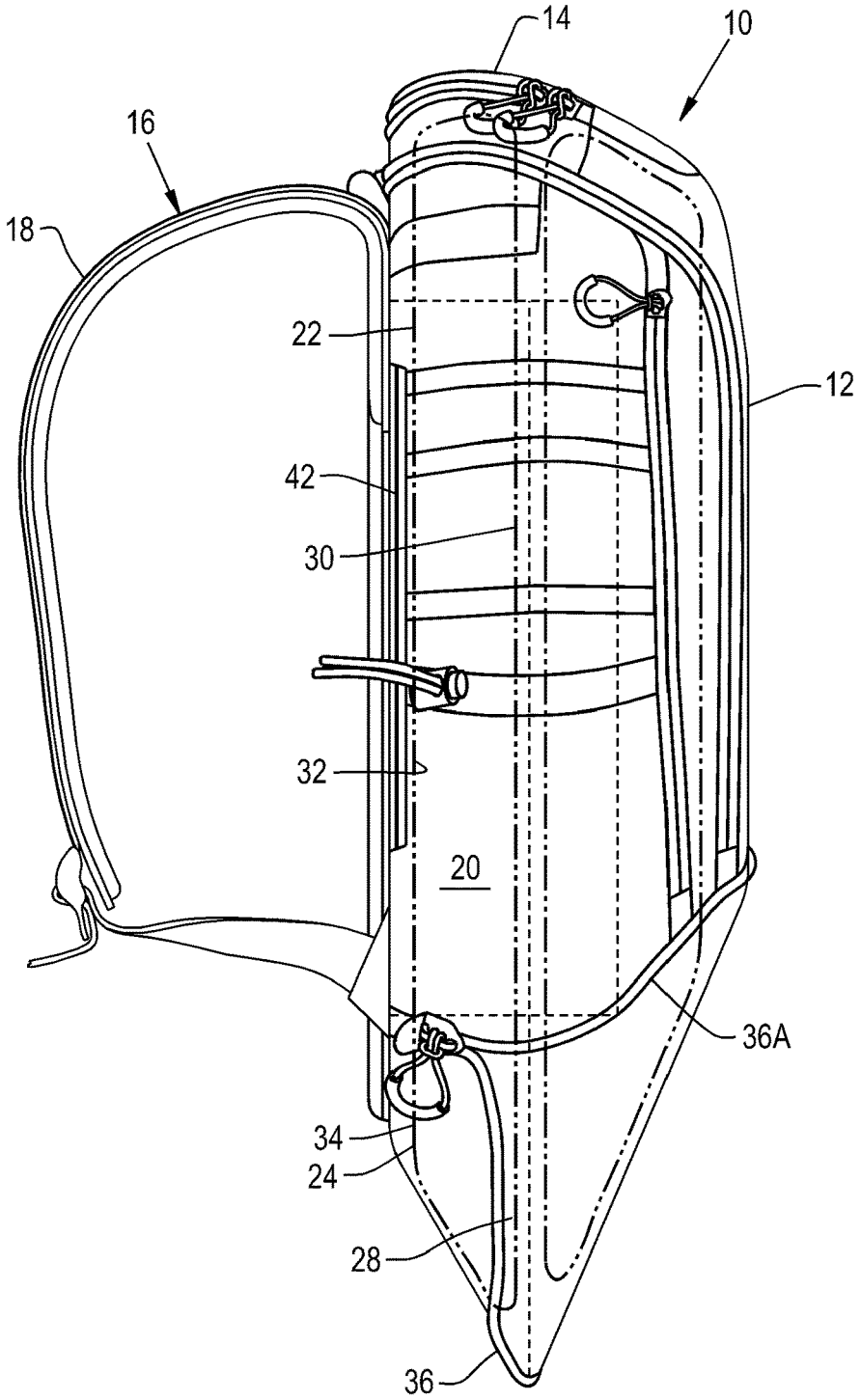
FIG. 5 is a side view of the backpack shown in FIGS. 1-4.
Figure 6:
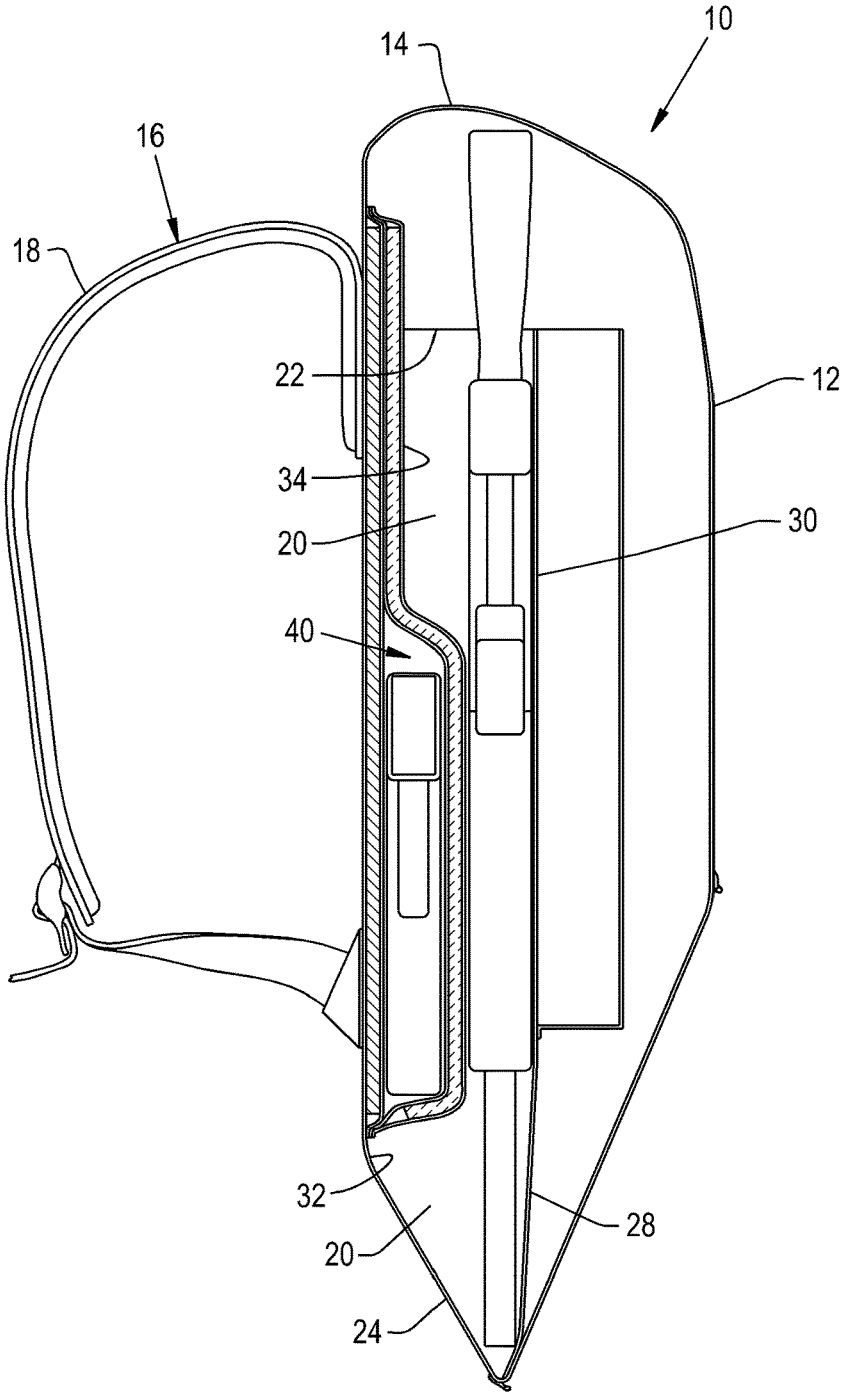
FIG. 6 is a sectional view taken along the section line 6-6 shown in FIG. 2.
Figure 7:
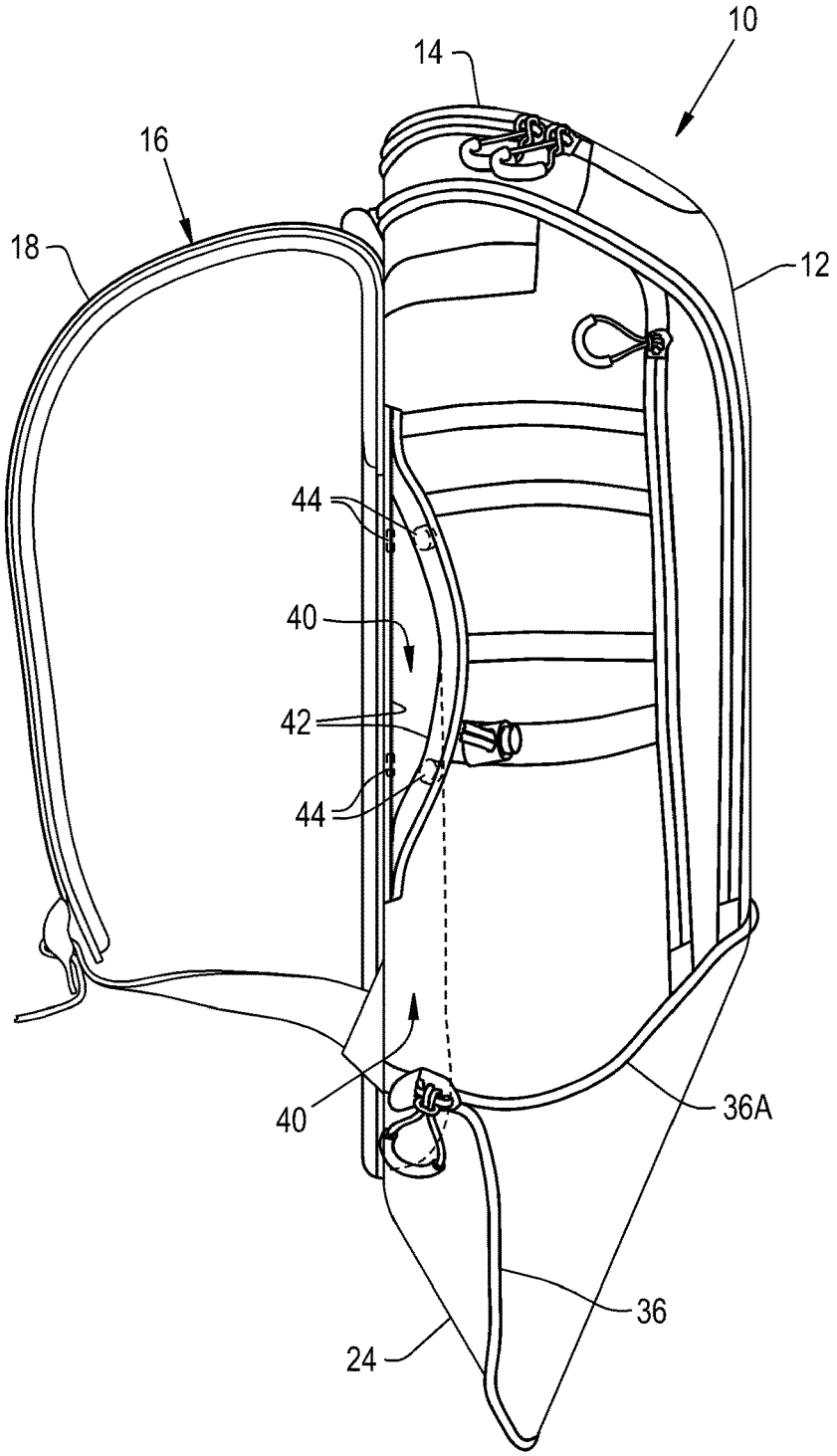
FIG. 7 is a side view of the backpack shown in FIGS. 1-6, with the access slit for the handgun pocket shown in an open position.
Figure 8:
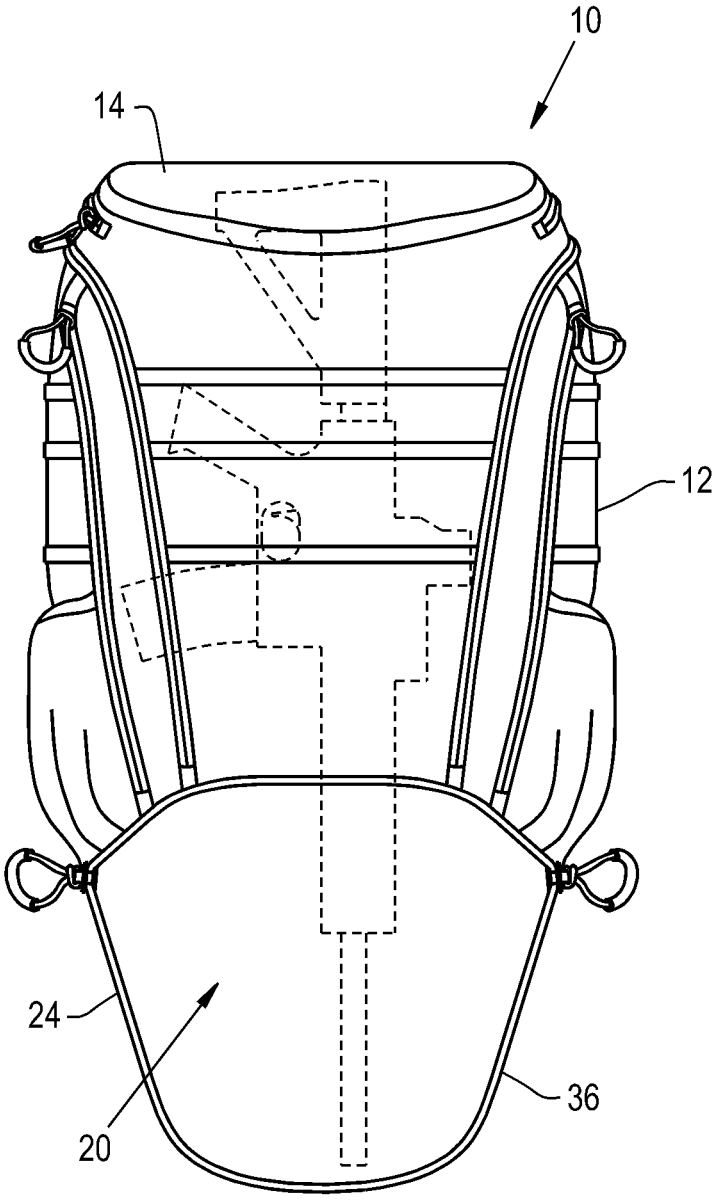

When the upper sleeve 22 has a wide width, such as the width of the main bag 12, it can also receive a laptop therein when the folding flap 26 is in a folded position (FIG. 3).

The lower sleeve 24 can also include an extension sock 38 which is configured to be rolled up and stowed between the folding flap 26 and the main bag 12 when the folding flap 26 is zipped to the main bag 12 in the folded position (FIGS. 9 and 10). The extension sock 38 is part of a front wall 28 of the lower sleeve 24.

According to another aspect of the present invention, the backpack 10 can also include another weapon carrier in the form of an easily accessible handgun pocket 40. As will be appreciated, there are instances when using a backpack having quick access to a handgun is not only desirable but in fact critical. For example, in a military environment, it may be highly desirable to keep the handgun stowed under normal circumstances in both a hidden and secure manner. However, an enemy can be encountered where it is absolutely critical to have quick access to the hidden and secured stowed handgun. As another example, in a hunting environment, there are occasions where a hunter may be hunting in areas with large predators such as grizzly bears. An aggressive bear can be encountered where it is likewise absolutely critical to have quick access to the hidden and secured stowed handgun.

The handgun pocket 40 includes at least one access slit 42 arranged in the main bag 12, with each access slit 42 having at least one magnetic closure 44 for keeping the access slit 42 in a normally closed position. In the embodiment shown, the backpack 10 includes two access slits 42, with each access slit 42 being arranged on an opposite side of the main bag 12, thereby allowing access to the handgun pocket 40 by either a right or left hand of a user. Also in the embodiment shown, the magnetic closure 44 is in the form of a number of opposite polarity magnets which are sewed into opposing sides of the access slit 42 which hold the access slit 42 in a closed position, but allow a user to quickly insert his hand through the access slit and break the magnetic coupling between the magnets to withdraw the handgun. The main bag 12 can have an internal frame (not shown) which assists in keeping the access slits 42 in the normally closed position, when a user is not reaching through one of the access slits 42.

The handgun pocket 40 can have an interior contour which is sized and shaped to maintain a handgun in a desired orientation, e.g., a barrel down orientation (such as a sewed holster-shaped contour, keeping the handgun in a desired orientation within the handgun pocket 40 (FIG. 4A)). In the embodiment illustrated in FIG. 4B, the backpack 10 includes two sewed restrictions 46, one adjacent to the bottom of each said access slit 42. The two sewed restrictions 46 are positioned at a distance from each other for receiving a handgun barrel therebetween and maintaining the handgun in a barrel down manner. In another embodiment (not shown), the handgun pocket can include a holster positioned therein for receiving a handgun. The holster can be fixed within the handgun pocket, or removable from the handgun pocket for separate use by the user (such as on the belt of the user).

The handgun pocket 40 can be arranged within the backpack 10 such that it lies adjacent to a rear wall of the main bag 12. The internal long gun scabbard 20 can also be located adjacent to the handgun pocket, on a side opposite the user. In one embodiment, the handgun pocket 40 can be arranged such that the handgun can lie adjacent to a lower portion of the main bag and thereby lie adjacent to the lower hollow of a back of a user, and the long gun scabbard 20 can be arranged such that a butt stock of a rifle can lie adjacent to the shoulder blades of a user (see FIG. 6, where both a handgun and long gun are shown within the backpack 10). This allows the user to carry multiple guns with a minimum amount of sensation or discomfort on the back of the user.

In the illustrated embodiment, the backpack 10 includes both a long gun scabbard 20 and a handgun pocket 40. However, the backpack 10 need not necessarily include both the long gun scabbard 20 and the handgun pocket 40. There may be conditions where it is desirable to configure the backpack 10 with either the long gun scabbard 20 or the handgun pocket 40, but not both.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A backpack, comprising:

a main bag;

a long gun scabbard including an upper sleeve and a lower sleeve, the upper sleeve having a top opening accessible by a user, the lower sleeve being defined at least in part by a folding flap associated with the main bag, the lower sleeve having a front wall which is coextensive with a front wall of the upper sleeve, the lower sleeve also having a rear wall which is coextensive with a rear wall of the upper sleeve; and a handgun pocket having at least one side access slit, the handgun pocket being adjacent a lower portion of the main bag and forward of the long gun scabbard.

2. The backpack of claim 1, wherein the folding flap has a zippered peripheral edge which is removably attached to the main bag by a zippered interconnection.

3. The backpack of claim 1, wherein the upper sleeve has a width corresponding to a width of the main bag.

4. The backpack of claim 3, wherein the upper sleeve is sized and configured to receive a long gun when the folding flap is in an unfolded position, or a laptop when the folding flap is in a folded position.

5. The backpack of claim 1, wherein the lower sleeve includes an extension sock which is configured to be rolled up and stowed between the folding flap and the main bag when the folding flap is zipped to the main bag in the folded position.

6. The backpack of claim 5, wherein the extension sock is part of a front wall of the lower sleeve.

7. A backpack, comprising:

a main bag; and a handgun pocket with at least one access slit arranged in the main bag, each said access slit having at least one quick access closure for keeping the access slit in a normally closed position, the at least one access slit comprises two access slits, and the handgun pocket includes two sewed restrictions, one adjacent to each said access slit, the two sewed restrictions having a distance therebetween for receiving a handgun barrel and maintaining the handgun in a barrel down manner.

8. The backpack of claim 7, wherein the main bag has an internal frame which assists in keeping each said access slit in the normally closed position.

9. The backpack of claim 7, wherein the at least one access slit comprises two access slits, with each said access slit being arranged on an opposite side of the main bag, thereby allowing access to the handgun pocket by either a right or left hand of a user.

10. The backpack of claim 7, wherein the handgun pocket is contoured to maintain the handgun in the barrel down manner.

11. The backpack of claim 7, wherein the handgun pocket is arranged adjacent to a rear wall of the main bag.

12. The backpack of claim 11, wherein the backpack includes an internal rifle scabbard, located adjacent to the handgun pocket.

13. The backpack of claim 12, wherein the handgun pocket is arranged such that the handgun can lie adjacent to a lower portion of the main bag and thereby lie adjacent to a hollow of a back of a user, and the rifle scabbard is arranged such that a butt stock of a rifle can lie adjacent to shoulder blades of a user.

14. The backpack of claim 7, wherein the quick access closure includes a plurality of opposite polarity magnets which are sewed into opposing sides of each said access slit for holding the respective access slit in the normally closed position.

15. A backpack, comprising:

a main bag having a rear wall, a middle portion in between a pair of sides, and a lower portion; and a handgun pocket with at least one access slit arranged in the main bag, the handgun pocket having an interior contour which is sized and shaped to maintain a handgun in a barrel down manner when placed therein, the handgun pocket is located at the middle portion of the main bag and adjacent to the rear wall and the lower portion of the main bag such that the handgun is configured for resting adjacent to the rear wall of the main bag and a hollow of a back of a user of the backpack in the barrel down manner, and the at least one access slit is oriented toward one side of the pair of sides of the main bag.

16. The backpack of claim 15, wherein the handgun pocket has an interior contour configured as:

a holster; or two sewed restrictions sized and spaced apart for receiving a handgun barrel therebetween.

17. The backpack of claim 15, wherein the interior contour is configured as a holster, the holster being fixed within or removable from the handgun pocket.

* * * * *